US006629588B2

(12) United States Patent
Nykoluk et al.

(10) Patent No.: US 6,629,588 B2
(45) Date of Patent: Oct. 7, 2003

(54) RETRACTABLE IDENTIFICATION CARD HOLDER FOR A PIECE OF BAGGAGE

(75) Inventors: Cory O. Nykoluk, St. Louis, MO (US); Mark B. Nordstrom, Brentwood, TN (US)

(73) Assignee: TRG Accessories, L.L.C., St. Louis, MO (US)

( * ) Notice: Subject to any disclaimer, the term of this patent is extended or adjusted under 35 U.S.C. 154(b) by 38 days.

(21) Appl. No.: 10/086,384

(22) Filed: Mar. 1, 2002

(65) Prior Publication Data

US 2003/0164273 A1 Sep. 4, 2003

(51) Int. Cl.[7] ..... A45C 13/18; A45C 13/28; A45C 13/42

(52) U.S. Cl. ..... 190/102; 190/101; 190/39; 190/115; 40/6

(58) Field of Search ..... 190/101, 102, 190/39, 115; 40/6, 661.12

(56) References Cited

U.S. PATENT DOCUMENTS 1,277,778 A * 9/1918 Urband ..... 190/102
1,481,182 A * 1/1924 Brooks ..... 190/102
1,512,332 A * 10/1924 Goewey ..... 190/102
1,767,573 A * 6/1930 Braunstein ..... 190/102
D246,590 S * 12/1977 Sollazzi ..... 190/102
4,616,435 A * 10/1986 Perfect ..... 40/6
4,828,081 A * 5/1989 Nordstrom et al. ..... 190/102
5,566,798 A * 10/1996 Tsai ..... 190/39
5,575,362 A * 11/1996 Franklin et al. ..... 190/102

* cited by examiner

*Primary Examiner*—Sue A. Weaver
(74) *Attorney, Agent, or Firm*—Lewis, Rice & Fingersh

(57) ABSTRACT

A piece of baggage is provided with a retractable identification card holder that slides into and out of a receptacle. When substantially retracted from the piece of baggage, the identification holder is able to clearly display an identification card that has been secured thereto. At other times, the identification card holder can be retracted into the receptacle where it remains concealed from view and where it does not detract from the aesthetic appearance of the piece of baggage. A method of identifying a person associated with a piece baggage utilizing the piece of baggage described above is also disclosed.

8 Claims, 12 Drawing Sheets

RETRACTABLE IDENTIFICATION CARD HOLDER FOR A PIECE OF BAGGAGE

BACKGROUND OF THE INVENTION (1) Field of the Invention

This invention pertains to the field of baggage. More particularly, this invention pertains to a piece of baggage comprising a retractable identification card holder. The retractable identification card holder allows people to easily identify a particular person or entity associated with a piece of baggage when desired, by extending the retractable identification card holder therefrom. Furthermore, when otherwise desired, the identification card holder can be retracted substantially back into the piece of baggage so as not to detract from the aesthetic appearance of the piece of baggage.

(2) Description of the Related Art

Providing identification cards on articles of baggage for purposes of associating such articles with particular persons is well known in the art of baggage. As a result, many types of baggage are manufactured and sold with means to allow people to secure identification cards directly to such baggage.

Traditional means for securing identification cards to baggage include the use of identification card holders (or simply "luggage tags" as they are often referred to) that are loosely attached to a piece of baggage via a chain, strap, or other similarly flexible means. Such loosely attached identification card holders may simply pass through a perforation made in an identification card or can include a device, such as a sleeve having a transparent cover, that protects the identification card in some manner.

Yet other types of baggage comprise identification card holders that are directly attached thereto in a manner such that the holders remain fixed in orientation relative to the baggage. Some of such identification card holders also include means for protecting identifications cards held therein. Additionally, some baggage include means, such as a shroud of opaque material or other such devices, to conceal some or all of an identification card when such identification card is not in use.

Despite the various types of prior art identification card holders, the inventors of the present invention have appreciated a need for a means of securing an identification card to a piece of baggage in a manner in which the identification card can be quickly and easily observed when desired, yet which allows people to easily conceal the identification from sight when otherwise desired. In light of their appreciation, the inventor's have developed-the device and method that are the subject matter of the present invention.

SUMMARY OF THE INVENTION

The present invention pertains to a piece of baggage that is provided with a retractable identification card holder that slides into and out of a receptacle and a method of using the same. When substantially retracted from the piece of baggage; the identification holder is able to clearly display an identification card that has been secured thereto. At other times, the identification card holder can be retracted into the receptacle where it remains concealed from view and where it does not detract from the aesthetic appearance of the piece of baggage.

In general, a piece of baggage in accordance with the invention comprises a shell, a receptacle, and an identification card holder. The shell at least substantially encloses an internal volume that is configured and adapted to house articles for transportation. The receptacle is operatively connected to the shell in a manner such that the receptacle is generally fixed in orientation relative to the shell. The identification card holder is shaped and dimensioned to hold an identification card in a fixed orientation relative to the holder and is attached to the receptacle in a manner such that the holder cannot easily be detached from the receptacle, but such that the holder is also selectively and alternatively movable between a retracted position and an extended position relative to the receptacle. Additionally, the receptacle is configured and adapted to house the holder in a manner such that the holder is substantially concealed from the environment surrounding the shell when the holder is in the retracted position and such that an identification card being held by the holder will be substantially visible from the environment surrounding the shell when such a card is held by the holder and the holder is in the extended position.

The preferred method of using the piece of baggage in accordance with the invention pertains to a method of identifying a person associated with a piece baggage. In general, the method comprises providing the piece of baggage described above and providing an identification card having indicia that provides identification information pertaining to a person associated with the piece of baggage. The method further comprises securing the identification card to the identification card holder in a manner such that the identification card is fixed in orientation relative to the holder and grasping the identification card holder and moving the holder from the retracted position to the extended position. Finally, the method yet further comprises identifying the person associated with the piece baggage via the identification information provided on the identification card with the identification card secured to the identification card holder and with the identification card holder being in the extended position relative to the receptacle of the piece of baggage.

While the principle advantages and features of the invention have been described above, a more complete and thorough understanding of the invention may be attained by referring to the drawings and the detailed description of the preferred embodiments which follow.

BRIEF DESCRIPTION OF THE DRAWING FIGURES

Reference characters in the written specification indicate corresponding parts throughout the several views of the drawings.

DETAILED DESCRIPTION OF THE PREFERRED EMBODIMENTS

Figure 1:
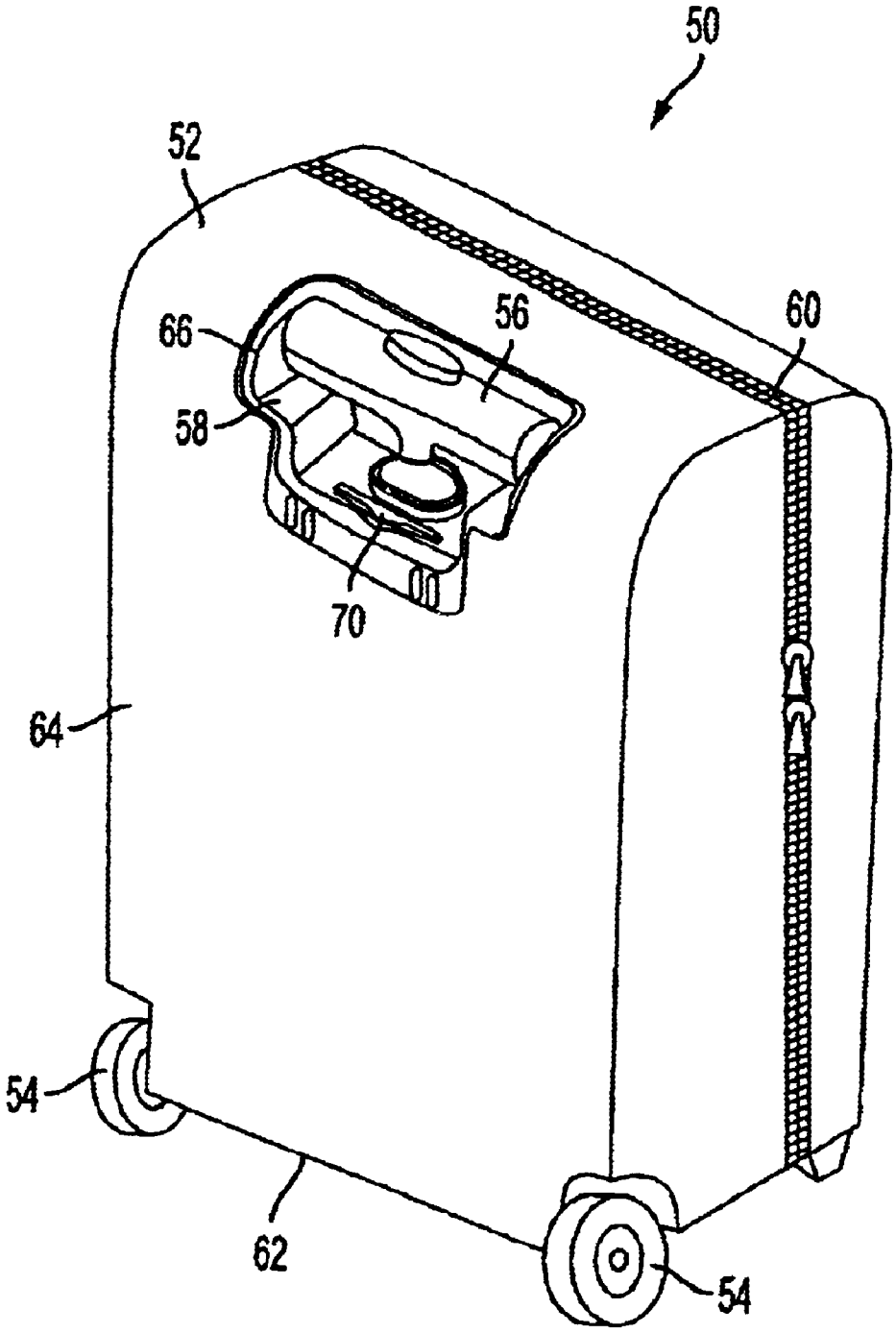
FIG. 1 is a perspective view of the preferred embodiment of a piece of baggage comprising a retractable identification card holder in accordance with the invention.

The preferred embodiment of a piece of baggage in accordance with the invention is generally shown in FIG. 1. The piece of baggage is provided with a retractable identification card holder that slides into and out of a receptacle. When substantially retracted from the piece of baggage, the identification holder is able to clearly display an identification card that has been secured thereto. At other times, the identification card holder can be retracted into the receptacle where it remains concealed from view and where it does not detract from the aesthetic appearance of the piece of baggage.

In general, the piece of baggage 50 of the preferred embodiment comprises a shell 52, a pair of towing wheels 54, a towing handle 56, and a towing handle cup assembly 58. The shell 52, of the piece of baggage SO encloses an internal volume that is configured and adapted to house articles for transportation and may have one or more zippers 60, or other closure mechanisms, for providing access thereto. The shell 52 is preferably formed of ballistic nylon and polyurethane foam but could also be formed of such materials as leather, plastic, metal, canvas, or other suitable material known in the field of baggage. Furthermore, the specific shape, construction, and details of the shell 52 of the piece of baggage are not critical to the present invention unless otherwise indicated and for this reason, a detailed description of the shell is not herein discussed. Nonetheless, it should be appreciated that many variations of baggage shells are know in the art and the shell 52 of the preferred embodiment of the present invention could take the form of any type of shell utilized for baggage.

Like the shell 52, the towing wheels 54 and the towing handle 56 of the piece of baggage 50 of the preferred embodiment are not unique to the present invention and are preferably of the type typically added to articles of baggage for purposes of allowing such baggage to be hand towed along the ground behind people. Thus, the details of various towing wheels and towing handles are not critical to the invention and any type such devices can be utilized in connection with the present invention. Furthermore, because such details are well known in the field of baggage, the details of the towing wheels 54 and towing handle 56 of the piece of baggage 50 of the preferred embodiment are not presented at length herein. Nonetheless, the towing wheels 54 are preferably positioned adjacent both the bottom wall 62 and a front wall 64 of the shell 58 and are preferably axially aligned with one another. The towing handle 56 is preferable connected to the shell 58 via a single-pole retractable towing member (not shown) of the type comprising a plurality of telescoping sections. Again, it should be appreciated that alternative towing members could also be any type of towing member, dual-pole or single-pole, telescoping or non-telescoping, or, in some cases, could even be absent altogether.

Figure 2:
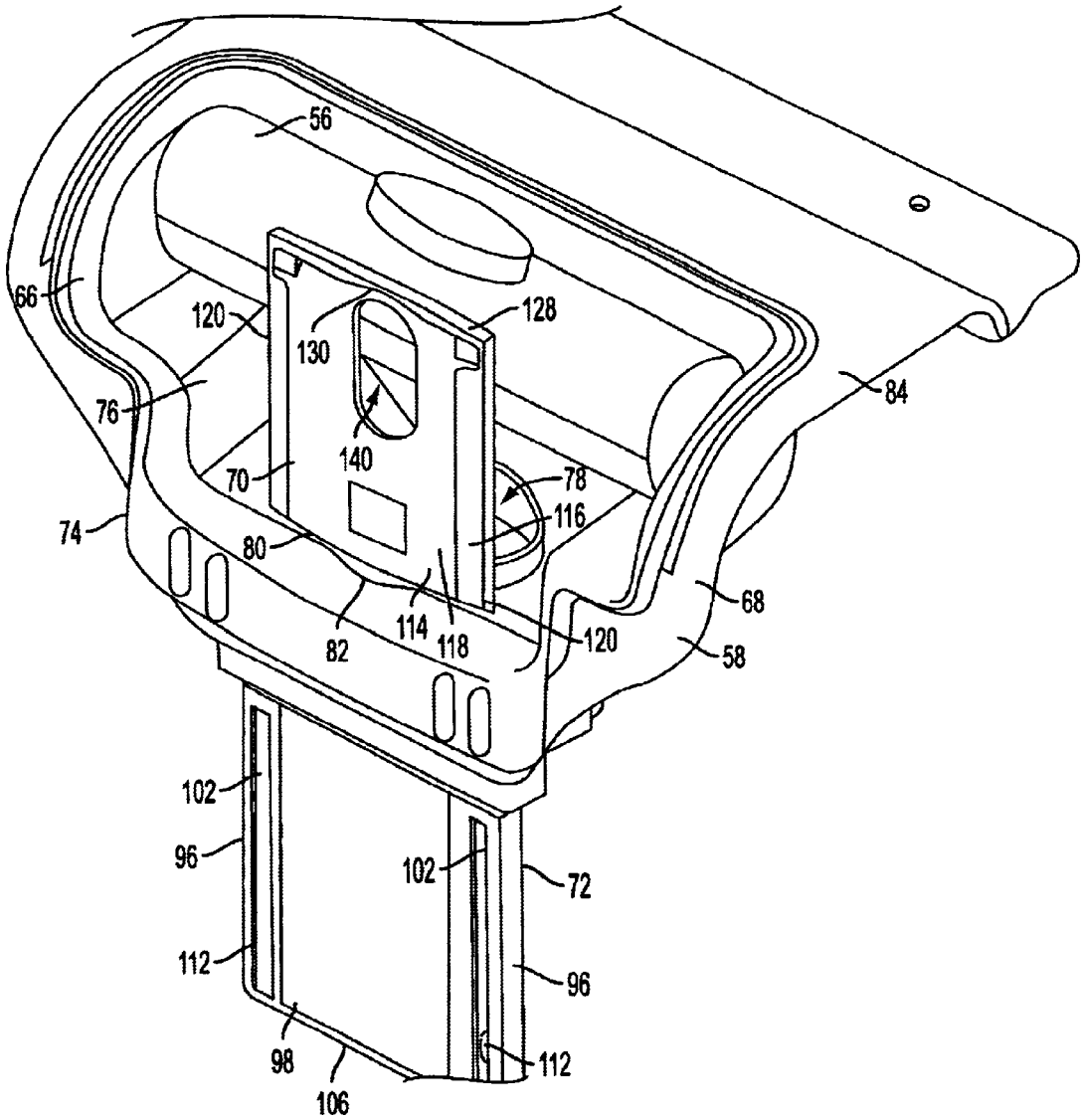
FIG. 2 is a perspective view of the cup assembly of the piece of baggage shown in FIG. 1, shown with the identification card holder in the extended position.
Figure 3:
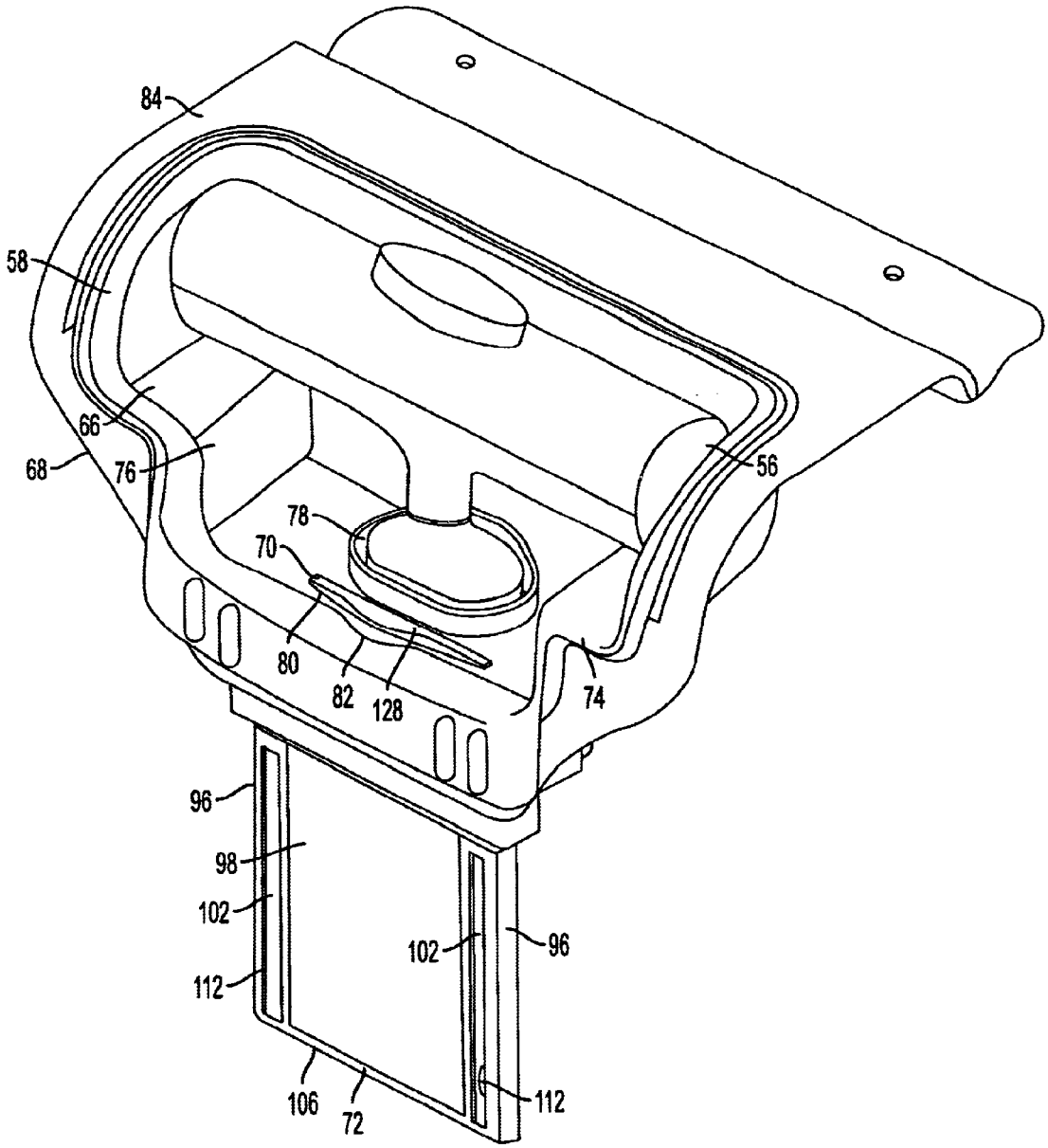
FIG. 3 is a perspective view of the towing handle cup assembly of the piece of baggage shown in FIG. 1, shown with the identification card holder in the retracted position.

The towing handle cup assembly 58 of the piece of baggage 50 of the preferred embodiment is shown by itself in FIGS. 2 and 3. In general, the towing handle cup assembly 58 comprises an exterior portion 66, an interior portion 68, an identification card holder 70, and a receptacle 72.

Figure 4:
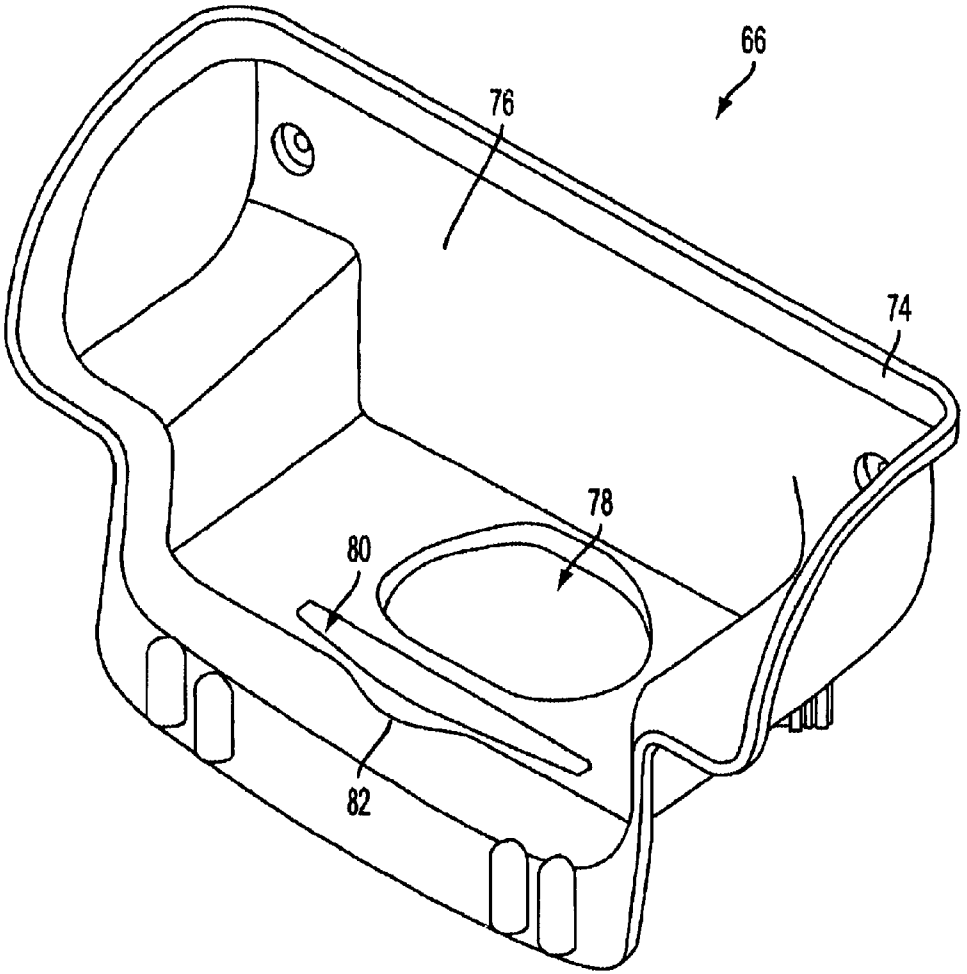
FIG. 4 is a perspective view of the exterior portion of the towing handle cup of the piece of baggage shown in FIG. 1.

The exterior portion 66 of the cup assembly 58 is shown by itself in FIG. 4 and is preferably formed of plastic. The exterior portion 66 of the cup assembly 58 has a peripheral edge 74 that is shaped to conform to the contour of the shell 52 of the piece of baggage 50 and has a recess 76 formed centrally therebetween. An oval opening 78 preferably passes through the exterior portion 66 for allowing the towing member that connects the towing handle 56 to the remainder of the piece of baggage 50 to pass therethrough. An elongated slot 80 also passes through the exterior portion 66 and is oriented parallel to the front wall 64 of the shell 52. The slot 80 preferably has an indentation 82 formed along one of its edges to facilitate the extension of the identification card holder 70 as described below.

Figure 5:
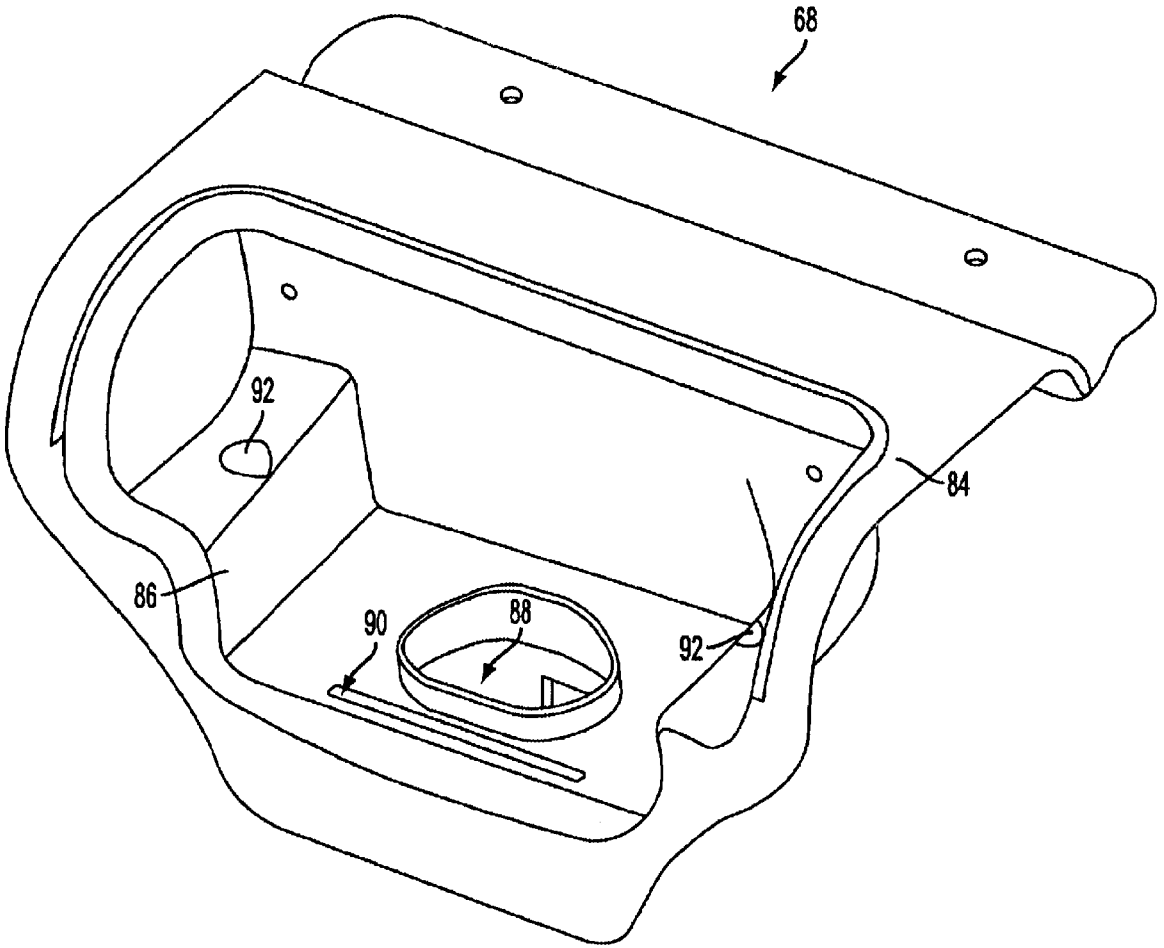
FIG. 5 is a perspective view of the interior portion of the towing handle cup of the piece of baggage shown in FIG. 1.

The interior portion 68 of the cup assembly 58 is shown by itself in FIG. 5 and is also preferably formed of plastic. Like the exterior portion 66, the interior portion 68 also has a peripheral edge 84 that is shaped to conform to the contour of the shell 52 and has a recess 86 formed centrally therebetween. Additionally, an oval opening 88 is provided for the towing member and a slot 90 is formed through the interior portion 68 for passage of the identification card holder 70. The recess 86 of the interior portion 68 is shaped to conform with the bottom side (not shown) of the exterior portion 66 of the cup assembly 58. A plurality of fastener holes 92 are also formed in the interior portion 68 and correspond with fastener holes (not shown) provided on the bottom side of the exterior portion 66 for purposes of assembling the exterior and interior portions together as described below.

Figure 6:
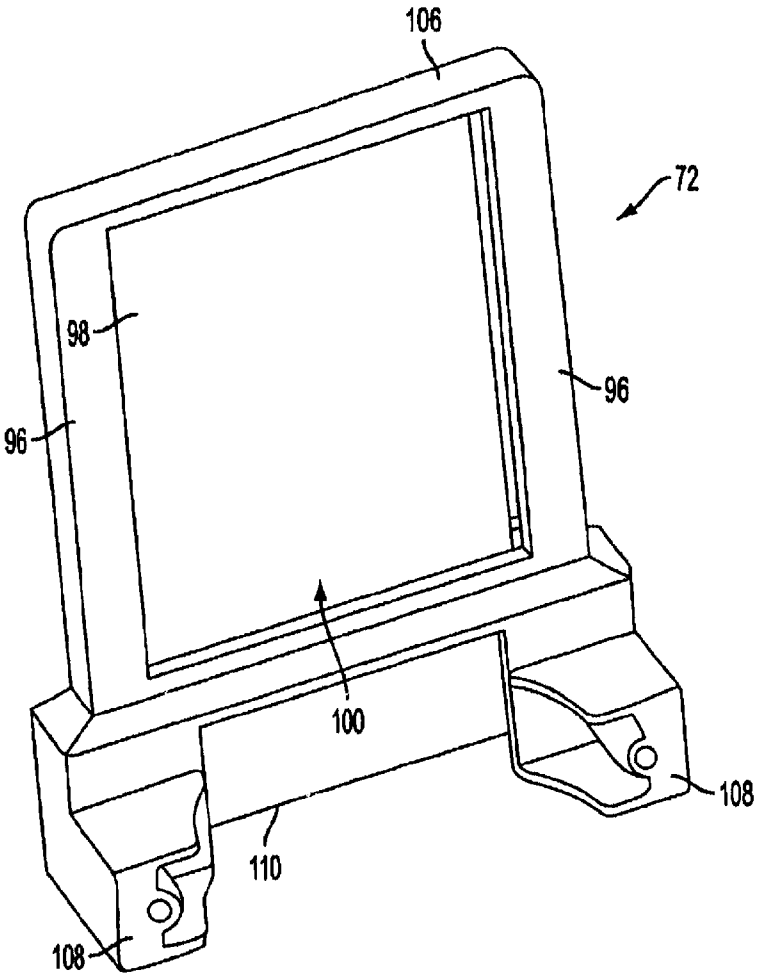
FIG. 6 is a perspective view of the identification card holder receptacle of the piece of baggage of FIG. 1.
Figure 7:
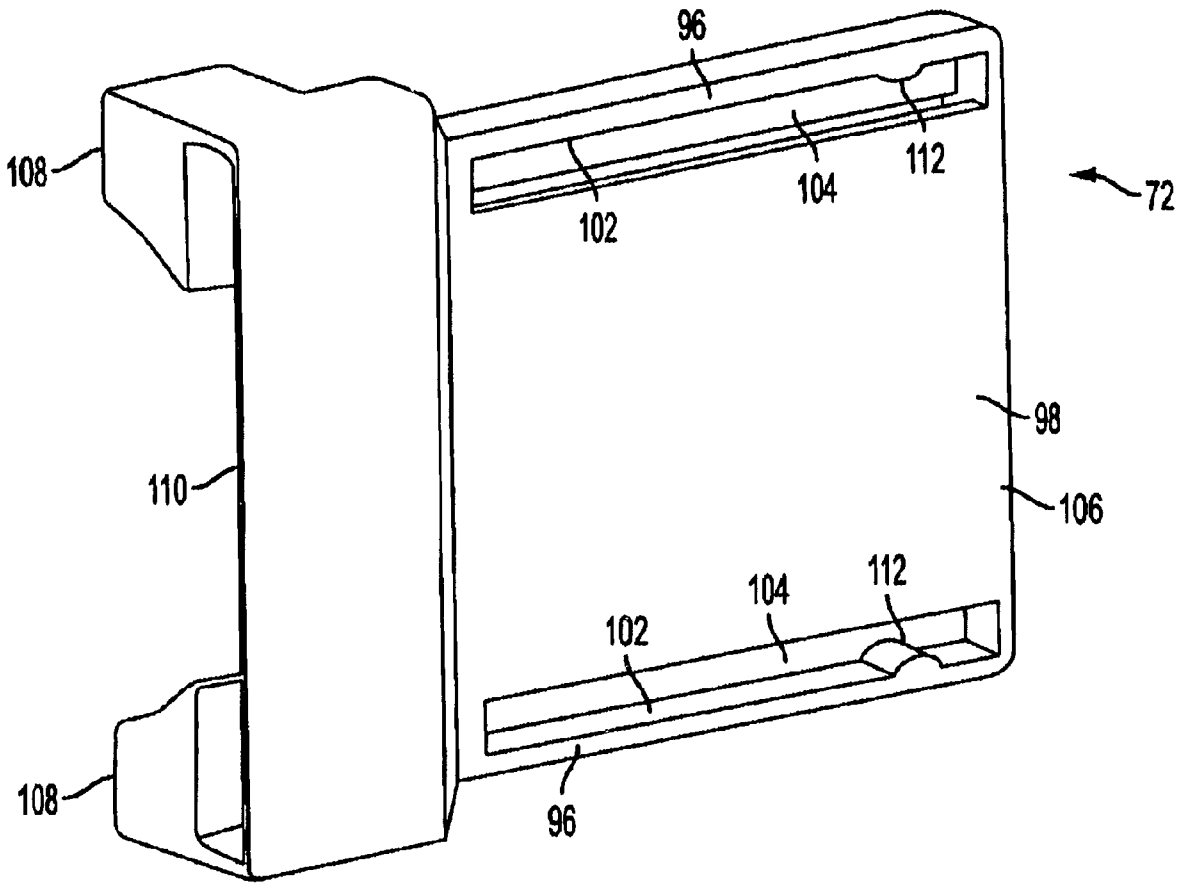
FIG. 7 is a perspective view of the identification card holder receptacle of the piece of baggage of FIG. 1, showing a side of the receptacle that is generally opposite of that shown in FIG. 6.
Figure 13:
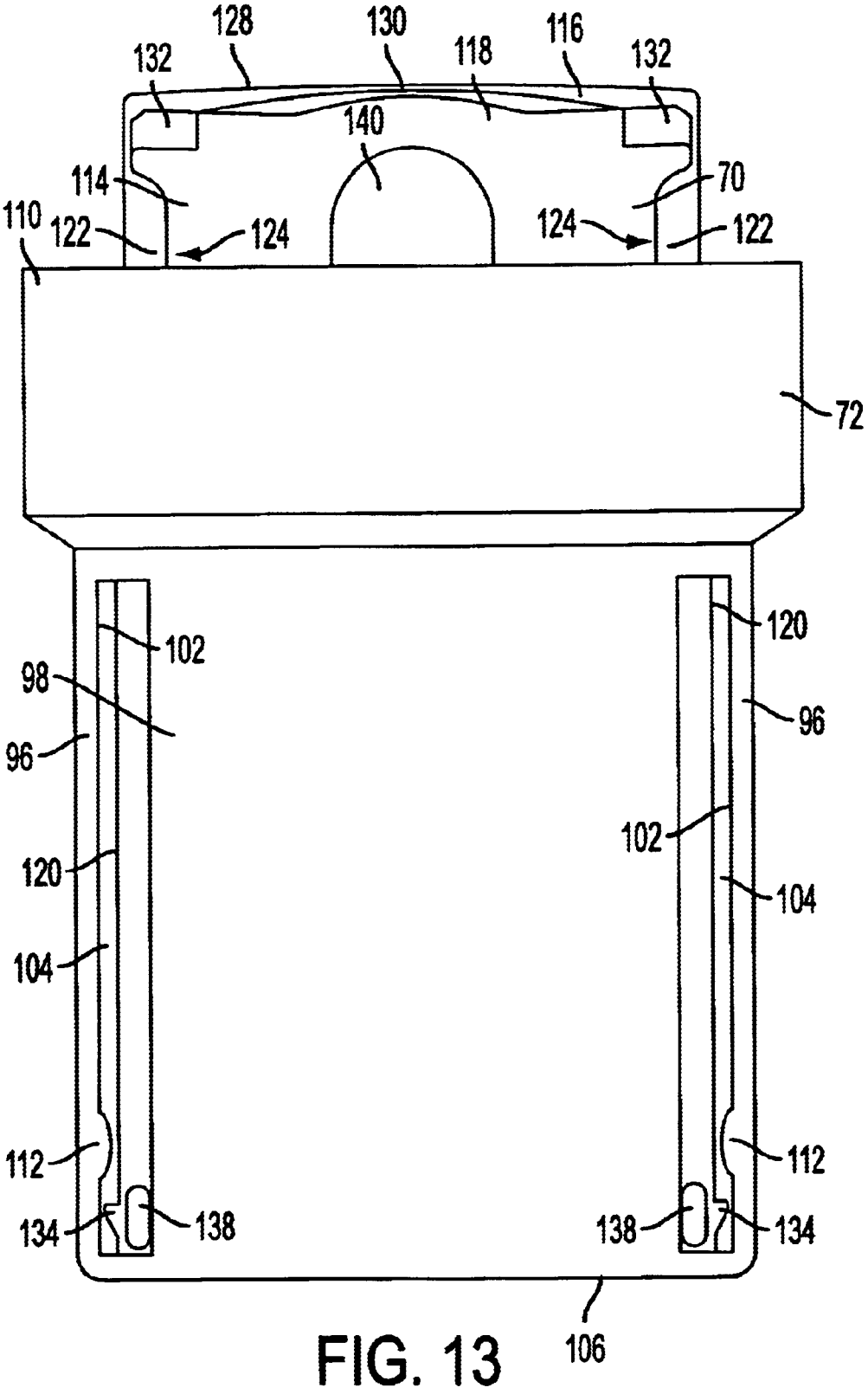
FIG. 13 is view showing the identification card holder and receptacle assembly of the piece of baggage of FIG. 1, shown with the identification card holder positioned in the retracted position relative to the receptacle.

The receptacle 72 of the cup assembly 58 is shown by itself in FIGS. 6 and 7 and is also preferably formed of plastic. The receptacle 72 preferably has a pair right angle side rails 96 and a panel member 98 that together form a slot or pocket 100 for receiving the identification card holder 70 as shown in FIG. 13. The pocket 100 is defined by opposing surfaces 102 of the pair of side rails 96, and by the panel member 98 being spaced from the plane in which the coplaner surfaces 104 of the side rails lie. The pocket 100 of the receptacle 72 is also preferable closed at a first end 106 and the receptacle is provided with a pair of mounting posts 108 adjacent the opposite second end 110 of the pocket. Finally, an arched protuberance 112 is formed on each opposing surface 102 of the side rails 96 adjacent the first end 106 of the pocket 100 and each extends toward the other of the protuberances.

Figure 8:
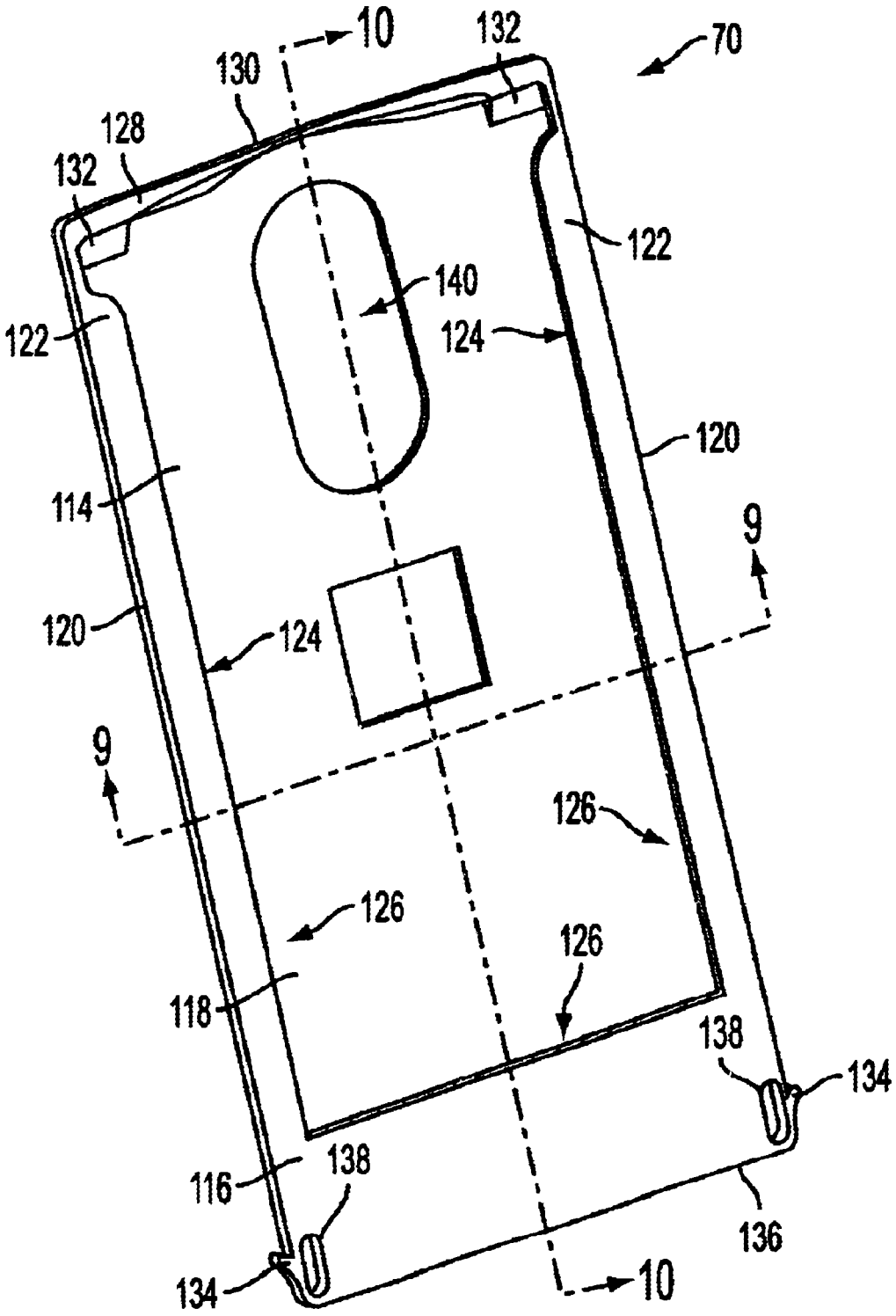
FIG. 8 is a perspective view of the identification card holder of the piece of baggage of FIG. 1.
Figure 9:
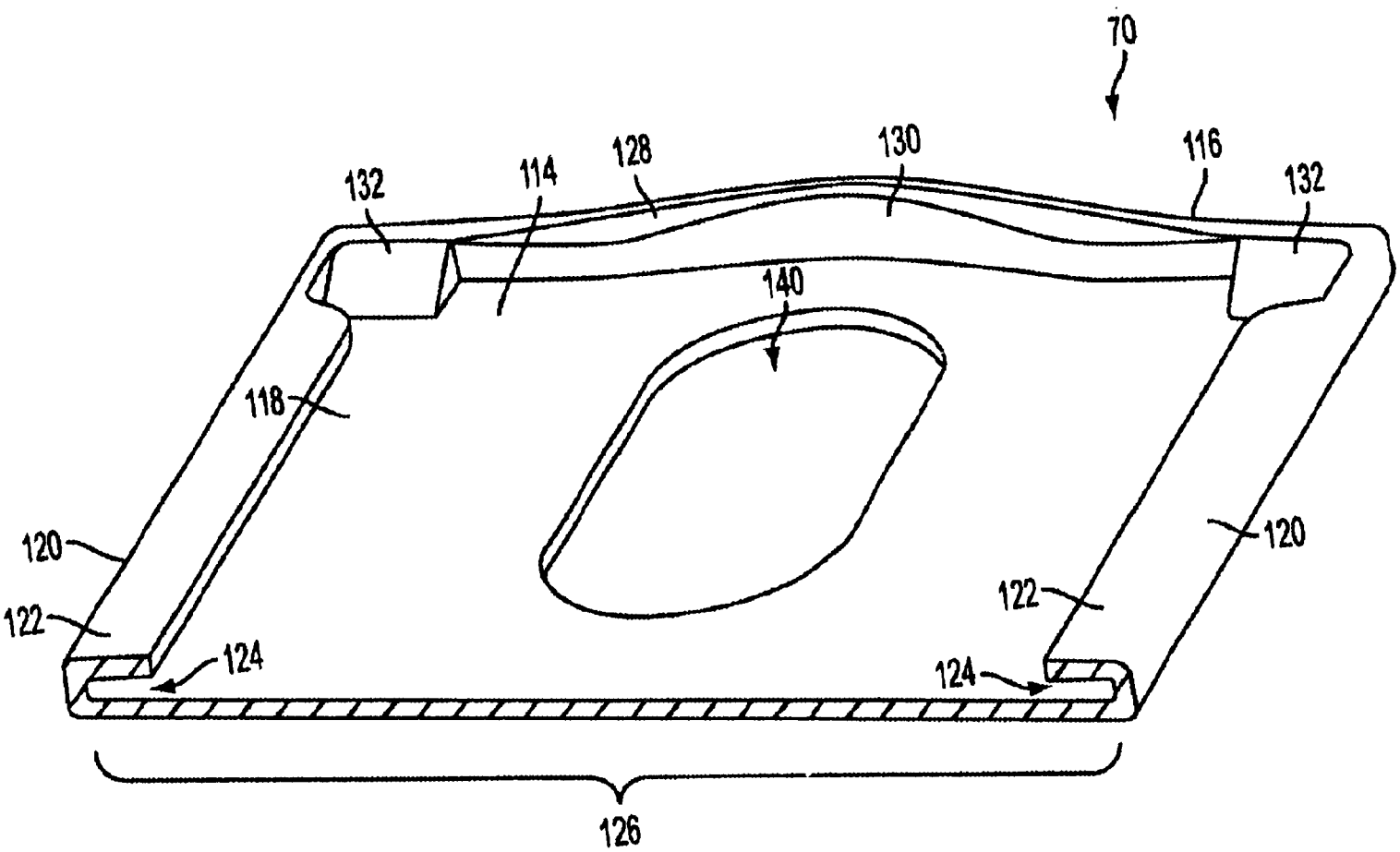
FIG. 9 is a perspective view of the identification card holder of the piece of baggage of FIG. 1 shown cross-sectioned about the line 9—9 in FIG. 8.

The identification card holder 70 of the cup assembly 58 is shown by itself in FIGS. 8 and 9 and is also preferably formed of plastic. The identification card holder 70 preferably comprises a generally flat, rectangular tray portion 114 that has a protrusion 116 surrounding its periphery that extends outwardly from a face 118 of the tray. On each of opposite longitudinal sides 120 of the holder 70, the protrusion 116 has lip 122 that is parallel to and spaced from the face 118 of the tray 114. The lips 122 of the protrusion 116 extend toward each other and form a edge channel 124 on each of the longitudinal sides 120 of the holder 70, thereby forming a slot 126 therebetween for holding an identification card. The top edge 128 of the protrusion 116 has an arched portion 130 that acts as a thumb catch for extending the holder 70 from the retracted position during its use as described below. At the top edge 128, the protrusion 116 also preferably has a pair of sloped surfaces 132 that intersect the tray portion 114 of the holder 70 for facilitating the removal of an identification card from the holder, as is also described below. The pair of wedge shaped protuberances 134 extend away from each other from the opposite longitudinal sides 120 of the holder 70 and are positioned adjacent to the bottom edge of the holder 136. Each of the wedge shaped protuberances 134 forms a barb and an oval hole 138 extends through the holder 70 immediately adjacent each of the protuberances to allow the protuberances to resiliently deflect toward each other when a compressive force is applied therebetween. Finally, an opening 140 extends through tray portion 114 of the holder 70 centrally between the longitudinal sides 120 and adjacent the top edge 128 of the holder to facilitate removal of an identification card, as discussed below.

Having described various components of the cup assembly 58 of the piece of baggage 50 of the preferred embodiment, the assembly of the cup and of the cup to the shell 52 of the piece of baggage will now be described. The cup assembly 58 is attached to the shell 52 of the piece of baggage 50 by sandwiching a portion of the shell between the exterior portion 66 and the interior portion 68 of the cup assembly. Fasteners (not shown) preferably extend from the interior volume of the shell 52 through the fasteners holes 92 of the interior portion 68, through the shell, and then into the fastener holes of the exterior portion 66 to clamp such components together. The second end 110 of the receptacle 72, is secured to the interior portion 68 of the cup assembly 58 within the internal volume of the shell 52 in a manner such that the pocket 100 is aligned with the slot 90 of the interior portion. This is preferably achieved via fasteners that pass through the mounting posts 108 of the receptacle 72. Finally, the identification card holder 70 is positioned partially within the pocket 100 of the receptacle 72 and extends through the slots 80,90 of the interior and exterior portions 66,68 of the cup assembly 58 with the face 118 of the tray portion 114 facing the front wall 64 of the shell 52.

Once assembled as described above, the identification card holder 70 is able to be manually moved back and forth between the extended position shown in FIG. 2 and the retracted position shown in FIG. 3 relative to the remainder of the piece of baggage 50. In the retracted position, as shown in FIG. 3, the identification card holder 70 is positioned substantially within the pocket 100 of the receptacle 72. The relative positions of the holder 70 and the receptacle 72 in this position are more clearly shown in FIG. 13. The length of the holder 70 is dimensioned greater than the depth of the pocket 100 such that holder extends through the slots 80,90 of the interior and exterior portions 66,68 of the cup assembly 58 and such that the top edge 128 of the holder lies substantially flush with the top surface of the exterior portion of the cup assembly. Thus, in the retracted position, the holder 70, and any identification card secured thereto, remains substantially concealed from the exterior environment of the piece of baggage 50.

When desired, the identification card holder 70 can be moved to it's extended position by grasping the arched portion 130 of the top edge 128 of the holder, which nests in the indentation 82 adjacent the slot 80 of the exterior portion 66 of the cup assembly 58 when the holder is in the retracted position. As the holder 70 is initially pulled vertically upward by its top edge 128, the protuberances 134 adjacent the bottom edge 136 of the holder engage the protuberances 112 of the receptacle 72, as can be appreciated from FIG. 13. The engagement of the protuberances 134,112 with each other requires at least a threshold vertical force to be exerted on the holder 70 relative to the remainder of the cup assembly 58. This threshold force causes the protuberances 134 of the holder 70 to deflect toward each other, to then allow the holder to freely slide vertically upward once the protuberances of the holder have translated above the protuberances 112 of the receptacle 72. Thus, the protuberances 134,112 of the holder 70 and receptacle 72 act as a locking mechanism to prevent the holder 70 from inadvertently moving from its retracted position during handling of the piece of baggage 50.

It should be appreciated that the slot 80 through the exterior portion 66 of the cup assembly 58, through which the holder 70 passes, is dimensioned to correspond to the dimension between the longitudinal sides of the holder 70. As a result, the barb shaped protuberances 134 of the holder 70 engage the periphery of the slot 80 when the holder is moved completely to the extended position and thereby prevent the holder from being completely removed from the cup assembly 58. In the extended position, the holder 70 extends upwardly into the recess 76 of the exterior portion 66 of the cup assembly 58 where any identification card secured to the holder can be easily viewed. It should also be appreciated that the slots 80,90 and the holder 70 are dimensioned such that the holder is able to swing slightly toward and away from the front wall 64 of the shell 52 of the piece of baggage 50 when the holder in its extended position. This ability to swing facilitates the viewing of any identification card secured to the holder 70. It should also be appreciated that, because the holder 70 is positioned substantially within the recess 76 of the exterior portion 66 of the cup assembly 58 when it is in the extended position, the holder is less likely to be damaged in the event that the piece of baggage 50 falls over or is otherwise roughly handled.

Figure 10:
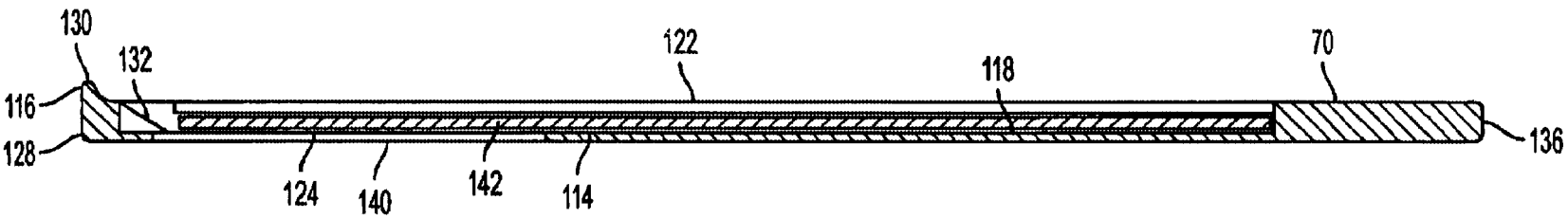
FIG. 10 is a cross-sectional view of the identification card holder of the piece of baggage of FIG. 1 with an identification card secured thereto, taken about the line 10—10 of FIG. 8.
Figure 11:
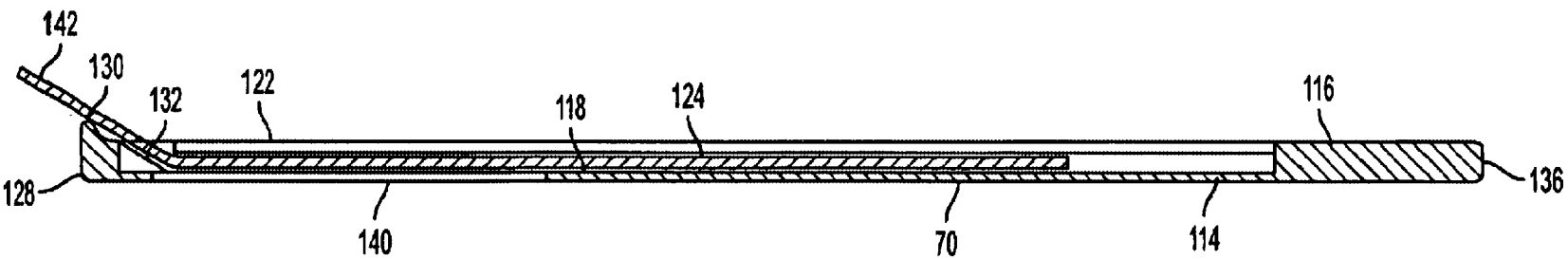
FIG. 11 is similar to FIG. 10 but is shown with the identification card only partially inserted into the identification card holder.
Figure 12:
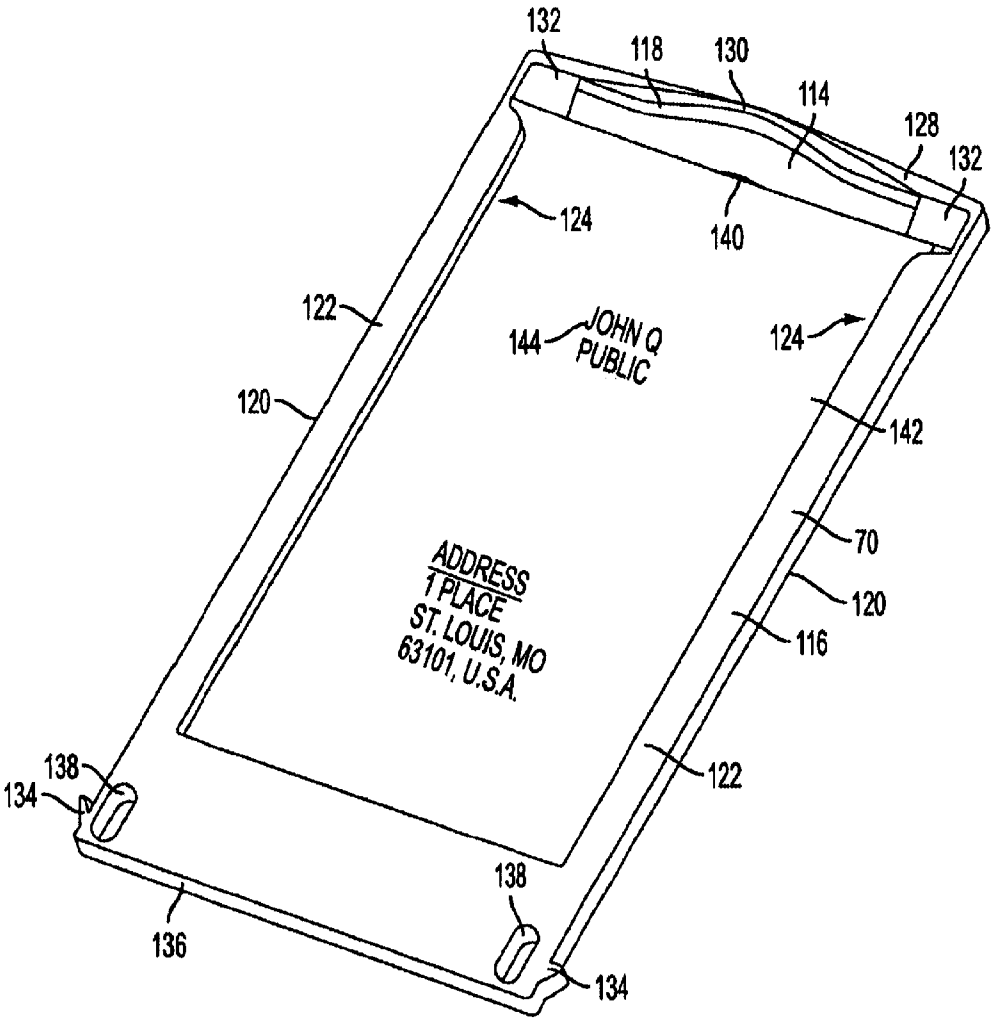
FIG. 12 is a perspective view of the identification card holder of the piece of baggage of FIG. 1 shown with an identification card secured thereto.

Referring now to FIGS. 10–12, the assembly of an identification card to the identification card holder 70 will now be discussed. An example of an identification card 142 is shown secured to the holder 70 in FIG. 12. The identification card 142 can be form of paper, cardboard, plastic, or other suitable materials and is preferably specifically dimensioned to cooperate with the slot 126 of the holder 70. Indicia 144 is provided on the card 142 and can be any type of indica such as text, symbols, trademarks, textures, or other suitable means for associating the card with a person (a person being hereby defined to include an individual, group, business or governmental entity, or organization). The card 142 is preferably secured to the holder 70 when the holder is in its extended position. This is done by siding the card into the slot 126 between the edge channels 124 of the holder 70, starting adjacent the top edge 128 of the holder where the edge channels terminate. Due to the fact that the protrusion 116 at the top edge 128 of the holder 70 extends outwardly from the face 118 of the tray portion 114 of the holder, the card 142 must be flexed during this process as shown in FIG. 11. Once the card 142 is fully inserted into the slot 126 of the holder 70, the card lies flat against the face 118 of the tray portion as shown in FIGS. 10 and 12. In this position, the protrusion 116 at the top edge 128 of the holder 70 prevents the card from being easily removed from the slot 126 and the card is therefore effectively secured to the holder.

To remove the card 142 from the holder 70, a person grasps the card between two figures via the opening 140 provided through the tray portion 114. Such a person can then force the card 142 upward relative to the holder 70 without exerting unnecessary friction between them. It should be appreciated that the card 142 must again be flexed as it is passed over the protrusion 116 at the top edge 128 of the holder 70. This flexing is initiated via the sloped surfaces 132 of the protrusion 116 at the top edge 128 of the holder 70.

While the present invention has been described in reference to specific embodiments, in light of the foregoing, it should be understood that all matter contained in the description or shown in the accompanying drawings is intended to be interpreted as illustrative and not in a limiting sense. For example, it should be appreciated that, although the identification card holder and the receptacle form part of the cup assembly of the preferred embodiment, the holder and the receptacle could alternatively be separate therefrom and be attached elsewhere to a piece of baggage. Furthermore, the identification card holder of the preferred embodiment comprises a tray portion, but it should be understood that numerous other devices such as a frame style of holder could also be used. Thus, it should be understood that various modifications and variations of the invention may be constructed without departing from the scope of the invention defined by the following claims.

What is claimed:

1. A piece of baggage comprising:

a shell at least substantially enclosing an internal volume, the internal volume being configured and adapted to house articles for transportation;

a receptacle operatively connected to the shell in a manner such that the receptacle is generally fixed in orientation relative to the shell;

an identification card holder shaped and dimensioned to hold an identification card in a fixed orientation relative to the holder, the holder being attached to the receptacle in a manner such that the holder cannot easily be detached from the receptacle and such that the holder is selectively and alternatively movable between a retracted position and an extended position relative to the receptacle, the receptacle being configured and adapted to house the holder in a manner such that the holder is substantially concealed from an environment external to the shell when the holder is in the retracted position and such that an identification card being held by the holder will be substantially visible from the environment external to the shell when such card is held by the holder and the holder is in the extended position; and a towing handle and a towing handle cup, the towing handle cup being connected to the shell of the piece of baggage and having a recess formed therein that is configured and adapted to allow the towing handle to be stowed therein in a manner such that the towing handle lies substantially flush with the shell, the receptacle being rigidly fixed to the towing handle cup in a manner such that the holder extends at least partially into the recess of the towing handle cup when the holder is in the extended position relative to the receptacle.

2. A piece of baggage in accordance with claim 1, wherein the holder has a longitudinal length, a lateral width, and a thickness, the thickness of the holder being dimensioned such that the thickness is substantially less than the width and the length of the holder, the holder being attached to the receptacle in a manner such that the holder moves in a lengthwise direction relative to the receptacle between the retracted and extended positions.

3. A piece of baggage in accordance with claim 1, further comprising a detent that is operatively connected to the holder and to the receptacle and that releaseably secures the holder in the retracted position and prevents the holder from moving toward the extended position until and unless a threshold force is exerted on the holder relative to the receptacle.

4. A piece of baggage in accordance with claim 3, wherein the detent comprises a resilient protrusion on the holder and complementary geometry on the receptacle that cooperate with one another, the protrusion on the holder also being shaped and dimensioned to engage a portion of the receptacle in a manner that prevents the holder from being detached from the receptacle.

5. A piece of baggage in accordance with claim 1, wherein the holder comprises a generally flat tray portion having a plurality of sides, the holder also comprising a plurality of edge channels extending along at least two of the sides of the tray portion that are configured and adapted to provide a slot into which an identification card can be inserted and held adjacent the tray portion with a substantial portion of the identification card remaining visually unobstructed by the holder when the card is inserted therein.

6. A piece of baggage in accordance with claim 5, wherein the tray portion is generally rectangular and one of the sides of the tray portion is devoid of any of the edge channels, the holder further comprising a protrusion on the one of the sides of the tray portion that is shaped and positioned such that the identification card must be flexed when such a card is being inserted into the slot of the holder and when such a card is being removed from the slot of the holder.

7. A piece of baggage in accordance with claim 6, wherein the protrusion of the one of the sides of the holder has a sloped surface that intersects the tray portion, the sloped surface being configured and adapted to facilitate the removal of the identification card from the slot of the holder by initiating the flexing of the card as such a card is being removed from the slot of the holder.

8. A piece of baggage in accordance with claim 7, wherein the holder further comprises an opening extending through the tray portion, the opening being configured and adapted to allow a person to place a finger at least partially therethrough in a manner such that the finger can be used to push the card partially away from the tray portion of the holder to facilitate the flexing of the card as such a card is being removed from the slot of the holder.

* * * * *